US006059271A

United States Patent [19]

Gerhardy

[11] Patent Number: 6,059,271

[45] Date of Patent: May 9, 2000

[54] CARBURETOR FOR AN INTERNAL COMBUSTION ENGINE

[75] Inventor: Reinhard Gerhardy, Korb, Germany

[73] Assignee: Andreas Stihl AG & Co., Waiblingen, Germany

[21] Appl. No.: 09/084,790

[22] Filed: May 27, 1998

[30] Foreign Application Priority Data

May 28, 1997 [DE] Germany ..... 197 22 319

[51] Int. Cl.[7] ..... F02M 17/04

[52] U.S. Cl. ..... 261/35; 261/51; 261/DIG. 68

[58] Field of Search ..... 261/35, 51, 39.3–39.5, 261/DIG. 68

[56] References Cited

U.S. PATENT DOCUMENTS

| | | | |
|---|---|---|---|
| 3,275,306 | 9/1966 | Phillips | 261/35 |
| 3,680,846 | 8/1972 | Bickhaus et al. | 261/51 |
| 3,689,036 | 9/1972 | Kikuchi et al. | 261/51 X |
| 4,216,175 | 8/1980 | Schauer | 261/51 X |
| 4,455,266 | 6/1984 | Gerhardy | 261/35 |
| 4,563,311 | 1/1986 | Agnew | 261/39.3 X |
| 4,770,823 | 9/1988 | Sejimo | 261/39.3 X |
| 4,877,560 | 10/1989 | Kenny et al. | 261/39.5 X |
| 5,441,673 | 8/1995 | Gerhardy | 261/35 X |
| 5,554,322 | 9/1996 | Kobayashi | 261/35 |
| 5,688,443 | 11/1997 | Swanson | 261/39.3 |

FOREIGN PATENT DOCUMENTS

| | | |
|---|---|---|
| 0688948 | 12/1995 | European Pat. Off. . |
| 195 04 400 | 8/1996 | Germany . |

*Primary Examiner*—Richard L. Chiesa
*Attorney, Agent, or Firm*—Walter Ottesen

[57] ABSTRACT

The invention is directed to a membrane carburetor which includes an intake channel having a throttle flap which is pivotally journalled. The carburetor also includes a control chamber from which fuel can be supplied to the intake channel. A valve is mounted in an ancillary channel and a corresponding adjustment of the throttle flap results in dependence upon the opening and closing position.

23 Claims, 5 Drawing Sheets

Fig. 2
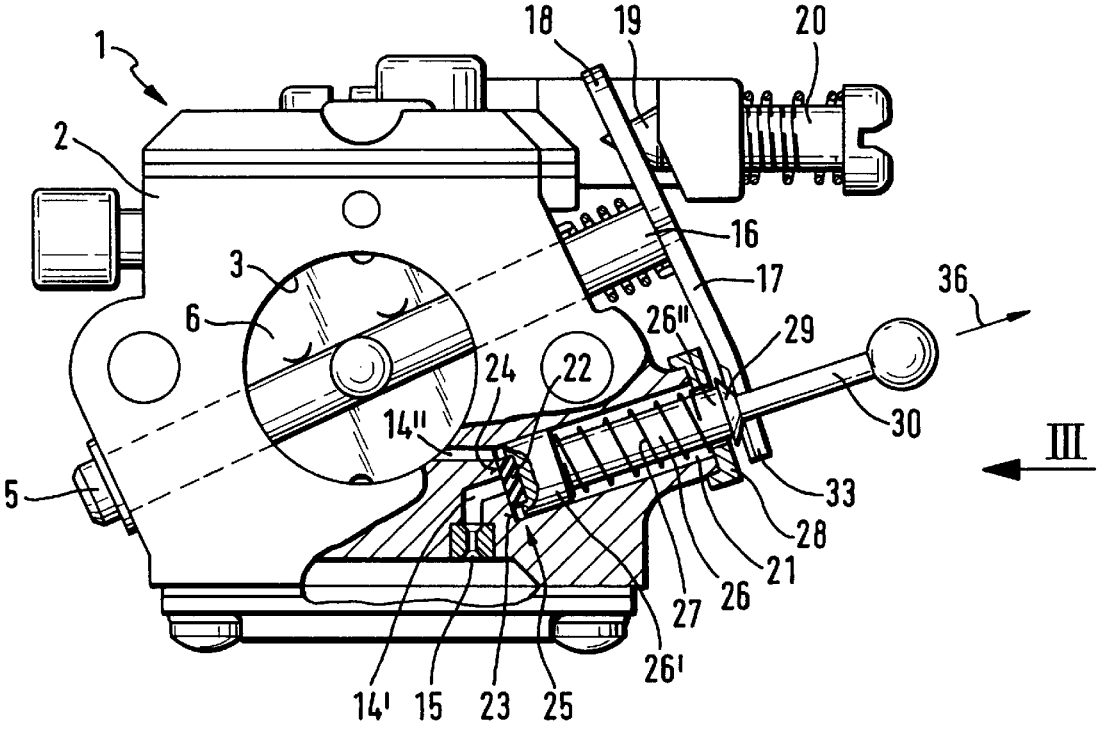
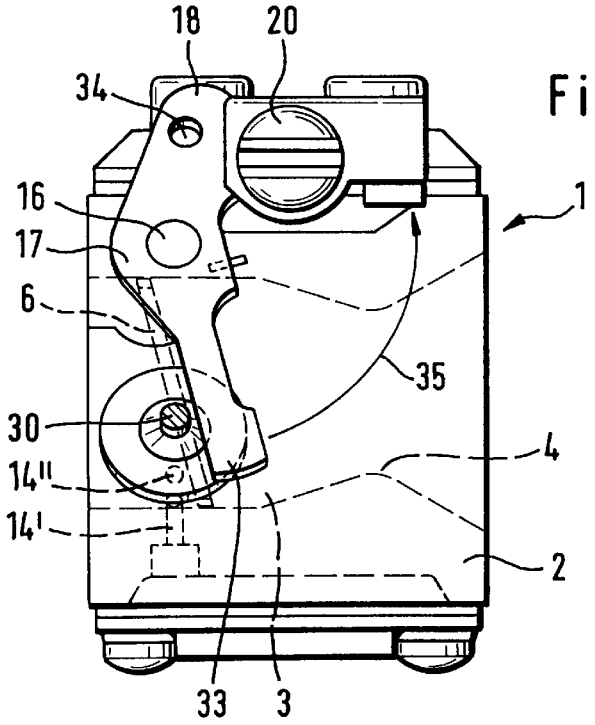
Fig. 3
Fig. 2a
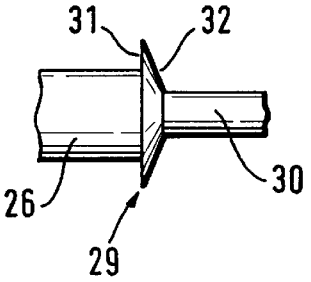

VIII
IX
SI
SII
L
M
30*
29
30
33
43''
46
47
45
44
40
2
22
28
43
41
42
43'
14''
24
14'
23
31
38
39
26
48
49
50
51
52
17
23*
14a

CARBURETOR FOR AN INTERNAL COMBUSTION ENGINE

FIELD OF THE INVENTION

The invention relates to a carburetor for an internal combustion engine of a portable handheld work apparatus.

BACKGROUND OF THE INVENTION

European patent publication 0,688,948 discloses a carburetor having an intake channel arranged in a carburetor housing. A throttle valve is provided in the intake channel and is attached to a throttle flap shaft. A mixture chamber is formed in the housing and is connected via a fuel input channel to a fuel chamber. An air intake channel connects the section of the intake channel, which is disposed upstream of the throttle flap, and functions to guide the air and mix the same with fuel in the mixture chamber. The outlet channel connects the mixture chamber to the intake channel downstream of the throttle flap so that an air/fuel mixture from the mixture chamber reaches the intake channel if, on the one hand, a valve for the ancillary channel, and, on the other hand, a valve for the air/fuel mixture are brought into a corresponding open position. These valve means include a rotating disc valve as well as a needle valve having functions which must be precisely matched to each other. However, considerable complexity with respect to structure results for the proper function.

German patent publication 195 04 400 discloses a carburetor for an internal combustion engine. An intake channel having a throttle flap is provided in the housing of this carburetor. The throttle flap is mounted in the intake channel so as to be pivotally journalled. A control chamber, which is filled with fuel, is connected via a main fuel channel and an idle fuel channel to the intake channel. Furthermore, a shunt channel is provided via which an additional quantity of air/fuel mixture can be supplied to the intake channel downstream of the throttle flap when starting.

SUMMARY OF THE INVENTION

It is an object of the invention to provide a carburetor which is simple in construction and is cost effective to manufacture.

The carburetor of the invention is for an internal combustion engine of a portable handheld work apparatus. The carburetor includes: a carburetor housing having an air-intake channel therein through which air flows to the engine; the air-intake channel defining a venturi section; a throttle flap assembly including a throttle flap pivotally mounted in the air-intake channel so as to be movable to positions including an idle position, a first start position and a second start position for allowing respectively different quantities of air to flow to the engine; a control chamber for holding fuel; a main fuel channel connecting the control chamber to the air-intake channel; an idle fuel channel also connecting the control chamber to the air-intake channel; an ancillary channel connecting the control chamber to the air-intake channel; a valve unit arranged in the ancillary channel; the valve unit including a valve closing element movable to close the valve unit and block the ancillary channel and to open the valve unit and clear the ancillary channel so that fuel can flow therethrough; and, coupling means for coupling the valve closing element to the throttle flap so as to cause the throttle flap to assume one of the first and second start positions when the valve unit is open.

The significant advantages of the invention are seen in that the valve in the ancillary channel is opened in the start position and, simultaneously, the throttle flap is brought into a position which departs from its idle position and permits an air quantity to pass to form a mixture with this air quantity being sufficient for starting the engine. In this way, and with slight structural complexity, the particular fuel component and air component for the formation of the rich mixture can be determined which is necessary for starting the engine.

According to an advantageous configuration of the invention, the valve is mounted on a first end of a valve shaft which is displaceable in a bore of the housing. The second end of the valve shaft projects out of the housing of the carburetor. This valve shaft can be displaced into at least one position by the axial movement in the open direction of the valve. It is, however, advantageous to provide adjustability into two pregiven positions. In this way, the position of the valve shaft determines the pivot angle of the throttle flap referred to the idle position thereof. For the case wherein two positions are provided, two different start positions can be adjusted, for example, for the start under normal conditions or, for the start at extremely low temperatures.

In order to limit the valve stroke of the valve closure element and also the stroke-dependent volume of the valve chamber, it is purposeful that the valve shaft can be displaced via a longitudinal movement into a first position and, via a following rotational movement, into a second position. In this way, two pregiven positions of the shaft are defined which determine the particular position of the throttle flap. For starting the engine, the throttle flap can be adjusted into at least one start position so as to be adapted to the engine requirement for the particular temperature conditions. For this purpose, the throttle flap is pivoted through an angle between 10° and 15° relative to the idle position. To start the engine at low temperatures, and especially at temperatures significantly below 0°, the valve shaft should be adjusted into the second position. Because of the low temperature of the air, the angle of the throttle flap is less than in the first position referred to the idle position and, for the second position, the position of the throttle flap is less than 10° and is preferably 7° to 8° relative to the idle position.

To couple the throttle flap to the valve shaft, it is purposeful to attach a lever to an end of a shaft carrying the throttle flap with this end projecting out of the housing. The lever is supported at a free end thereof on at least one peripheral surface of the valve shaft. In order to reach the two above-mentioned positions of the throttle flap, it is advantageous that the peripheral surface of the shaft has at least two steps following each other in the axial direction. Because of the different radial dimensions of the two steps, different positions of the lever are obtained referred to the longitudinal axis of the throttle flap shaft. As an alternative hereto, the peripheral surface of the valve shaft can be configured as a radial coulisse so that the different positions of the lever on the throttle flap shaft can be assumed by rotating the valve shaft.

At the outer end of the shaft, a bolt is provided which has a significantly lower cross section than the shaft. For the closed valve, the free end of the lever is disposed in the region of the bolt. A radial spacing between the outer surface of the bolt and the lever is provided. For this reason, and for a closed valve, it is not the bolt which determines the position of the lever and that of the throttle flap; instead this is effected via a idle screw engaging at the other end of the lever. A radial collar is provided between the end of the shaft and the bolt. The collar has a wall extending perpendicularly to the longitudinal axis of the shaft at the side thereof facing toward the shaft and, on the side of the collar facing toward the bolt, the collar has the shape of a truncated cone. The surface of the radial collar facing toward the shaft serves to engage the shaft so that the valve in the ancillary channel can be closed only when the lever is pivoted with the throttle flap shaft when the throttle line is actuated.

The radial collar is configured so as to be conically truncated on the side thereof facing the bolt and the lever is provided with a bevel on the end thereof facing toward the truncated cone. In this way, the lever can be pivoted in a simple manner in order to overcome the radial collar for adjusting the start position. The valve is resiliently biased by a spring so that the valve can be returned to the closed position after the start phase is completed. For this purpose, a helical spring can be used. One end of the helical spring is held in the shaft and the other end is held in the housing so that a rotational movement can be simultaneously generated if the shaft is intended to execute the same. In this way, the helical spring can serve for resetting in the rotational direction as well as in the axial direction of the shaft.

BRIEF DESCRIPTION OF THE DRAWINGS

The invention will now be described with reference to the drawings wherein:

FIG. 2 is a side elevation view of the membrane carburetor as seen in the direction of arrow II of FIG. 1 with the throttle flap in the idle position;

FIG. 2*a* is a detail view of a shaft of the membrane carburetor with the shaft having a radial collar;

FIG. 3 is a view of the membrane carburetor in the direction of arrow III of FIG. 2;

DESCRIPTION OF THE PREFERRED EMBODIMENTS OF THE INVENTION

Figure 1:
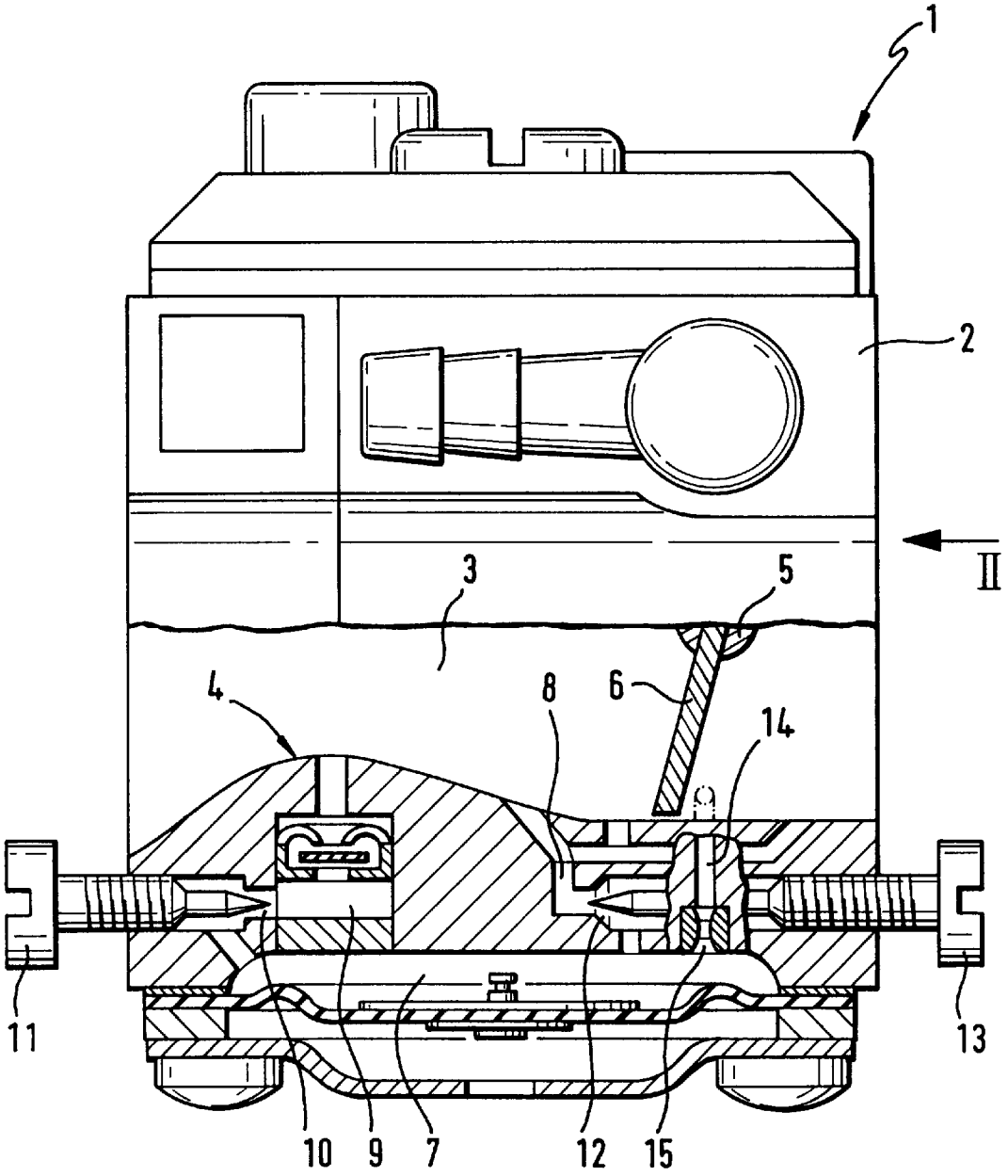
FIG. 1 is a side elevation view, partially in section, of a membrane carburetor according to an embodiment of the invention.

In FIG. 1, a membrane carburetor 1 is shown. The upper half is shown as the outer view of a housing 2 and the lower half is shown in longitudinal section. An intake channel 3 having a venturi section 4 is located in the housing 2 of the membrane carburetor 1. A throttle flap 6 arranged on a shaft 5 is provided rearward of the venturi section as seen in the direction of air flow. In the lower region of the housing 2, a control chamber is shown which is connected via an idle fuel channel 8 and a main fuel channel 9 to the intake channel 3. The main fuel channel 9 opens into the intake channel 3 in the region of the venturi section 4 and is provided with a main fuel valve 10. The cross section of the valve is adjustable by means of an adjusting screw 11.

An idle valve 12 is provided in the idle fuel channel 8 and can be adjusted via an adjusting screw 13. The idle fuel channel branches downstream of the idle valve 12 in order to open into the intake channel 3 at different positions forward and rearward of the throttle flap 6. Furthermore, an ancillary channel 14 is provided which, starting from the control chamber 7, leads to the output end of the intake channel 3. The fuel which passes through can be controlled via a valve and the maximum quantity which can pass through is determined by a fixed throttle 15 arranged at the end of the ancillary channel 14 facing toward the control chamber. This valve will be described below with reference to the other drawings. The fixed throttle 15 preferably has a throttle diameter of 0.3 mm; however, other throttle diameters can also be provided.

FIG. 2 shows the membrane carburetor 1 in a view as seen in a direction of arrow II of FIG. 1. The region of the ancillary channel 14 is shown in section. This ancillary channel can be blocked or cleared by means of a valve. In FIG. 2, the intake channel 3 is provided with a throttle flap 6. The shaft 5 extends through the housing 2 and a lever 17 is attached to the end 16 of the shaft 5 with the end 16 extending out of the housing 2. The lever 17 is thereby journalled so as to be pivotable about the rotational axis of the shaft 5 so that the actuation of the lever 17 leads to an adjustment of the throttle flap 6 in the intake channel 3. A conical tip 19 of an adjusting screw 20 engages the end 18 of the lever 17. With the adjusting screw 20, the closed position of the throttle flap 6 and therefore the idle position can be adjusted.

As shown in section in the lower portion of FIG. 2, a bore 21 configured as a blind bore is provided in the housing 2. A longitudinally displaceable valve closure element 22 is guided in bore 21. The ancillary channel 14 includes two sections 14' and 14". Section 14' leads from the fixed throttle 15 into the bore 21 and opens in the center of an end wall 23. In contrast, section 14" leads from the peripheral region of the end wall 23 to the intake channel 3. The region of the end wall 23 surrounding the section 14' of the ancillary channel 14 functions as valve seat 24 for the valve closure element 22 so that a valve 25 is defined. The valve 25 clears or blocks the fuel flow. The valve closing element 22 is attached to the end of the valve shaft 26 and the valve shaft 26 has a cylindrical section 26' for guidance within the bore 21.

The valve shaft 26 has a radial spacing to the bore 21 over the greater part of its axial length. A pressure spring 27 is arranged in the bore 21 and resiliently biases the valve closing element 22 in the closing direction of the valve 25. This pressure spring 27 is braced, on the one hand, against the cylindrical section 26' of the valve shaft 26 and, on the other hand, on a cap 28 engaging over the outer end of the bore 21. A radial collar 29 is arranged at an end 26" of the valve shaft 26. The end 26" projects out of the bore 21. A bolt 30 is provided at the other end face of the radial collar 29 and has a diameter significantly less than the cross section of the valve shaft 26.

As shown in FIG. 2*a*, the radial collar 29 has a radial wall 31 at the side thereof facing toward the valve shaft 26. In contrast, the collar 29 has a conical truncated shape on the side 32 thereof facing toward the bolt 30. The lever 17 has a free end 33 which extends up to the region of the bolt 30. Accordingly, and via an axial displacement of the valve shaft 26, the free end 33 of the lever 17 can be coupled to the valve shaft 26 so that the particular position of the valve 25 (opened or closed) has an effect on the position of the throttle flap 6.

FIG. 3 shows a view in the direction of arrow III of FIG. 2. The lever 17 is attached to the shaft end 16 and the free end 33 of the lever extends laterally next to the bolt 30 and has a spacing relative thereto. This spacing results from fixing the idle position of the throttle flap 6 via the adjusting screw 20. The lever 17 is pivotable via a throttle line hooked into an opening 34 of the end 18 of the lever 17.

As shown in FIG. 3, the lever 17 can be pivoted in the counterclockwise direction as indicated by arrow 35. As FIG. 3 is an external view, the contours of the intake channel 3 as well as the throttle flap 6 and the course of the ancillary channel 14 having sections (14', 14") are shown with broken lines.

Figure 4:
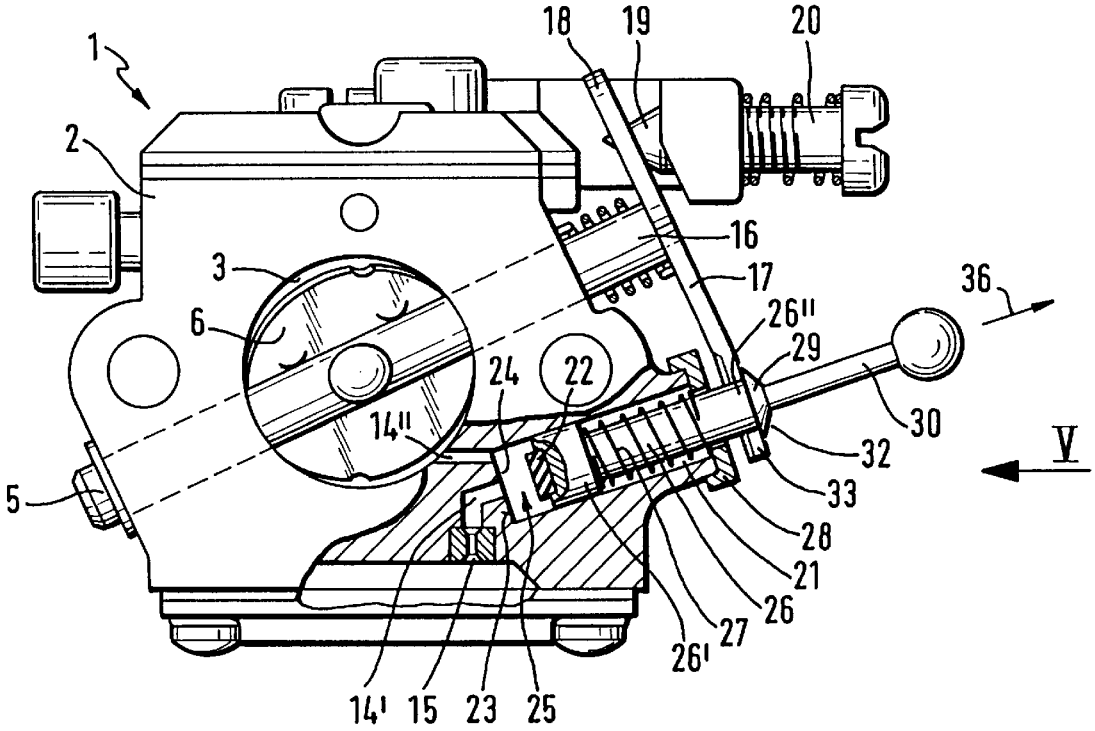
FIG. 4 is a view of the membrane carburetor corresponding to FIG. 2 but with the throttle flap in the start position.

FIG. 4 shows a carburetor 1 of the type shown in FIG. 2. However, here the valve 25 is in the open position and therefore makes possible a flow of fuel through the ancillary channel 14. The parts of FIG. 4 which correspond to those of FIG. 2 are provided with the same reference numerals. The position of the valve 25 corresponds to the start position of the carburetor and this position is reached in that the bolt 30 is pulled in the outward direction of double arrow 36.

Figure 4A:
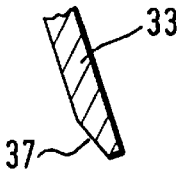
FIG. 4*a* is a detailed view showing the free end of a lever of the membrane carburetor.

The side 32 of the radial collar 29 has a conical truncated shape. FIG. 4*a* shows a detail of the free end 33 of the lever 17. The end 33 has a bevel 37 on the side of the free end facing toward the truncated cone surface of the collar 29. Because of the conical truncated shaped end 32 of the collar 29 and the bevel 37 of the lever 17, the inclined surfaces slide upon each other so that the lever 17 is pivoted about the longitudinal axis of the shaft 5 and the throttle flap 6 is rotated likewise about the same angle. In this way, the free end 33 slides past the collar 29 and becomes positioned behind the radial wall 31 and engages on the outer surface of the valve shaft 26.

Figure 5:
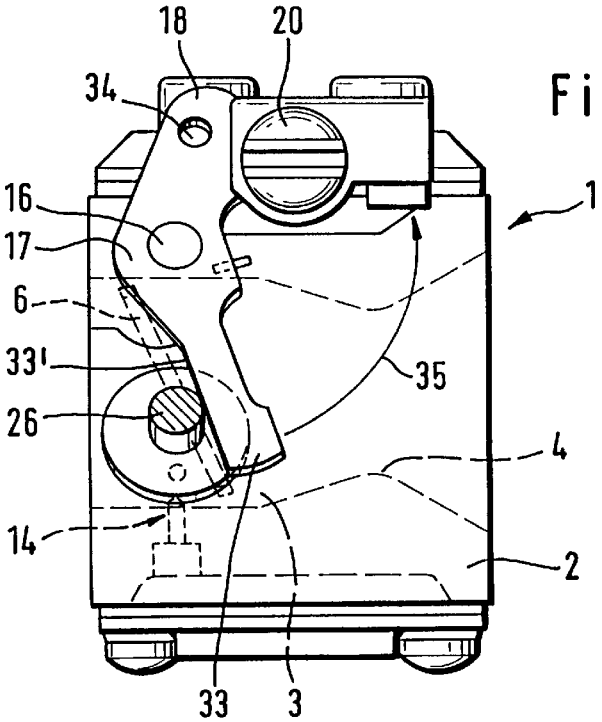
FIG. 5 is a side elevation view of the membrane carburetor as seen in the direction of arrow V of FIG. 4.

The lever 17 assumes a position, which is changed with respect to the idle position, because the cross section of the valve shaft 26 is significantly greater than the cross section of the bolt 30 as shown in FIG. 4. Referring to FIG. 5, this angular position of the lever 17 (rotated relative to the idle position) leads to a rotation of the throttle flap 6 by approximately 10° to 15° relative to the idle position shown in FIG. 3. The direction of the bore 21 can be determined depending upon construction.

In the embodiments of FIGS. 2 and 4, the angle between the longitudinal axis of the bore 21 and the shaft axis of the throttle flap shaft 5 is approximately 8°. An axially parallel alignment of the throttle flap shaft and the bore can be advantageous for manufacturing reasons. From FIG. 5, it can be seen that the lever 17 lies with its side edge 33' against the surface of the valve shaft 26. This effects the above-described adjustment of the throttle flap 6 in the start position as can be seen from the angular position of the throttle flap shown with broken lines in FIG. 5.

Figures 6, 7, 8A, 8B, 9, 10:
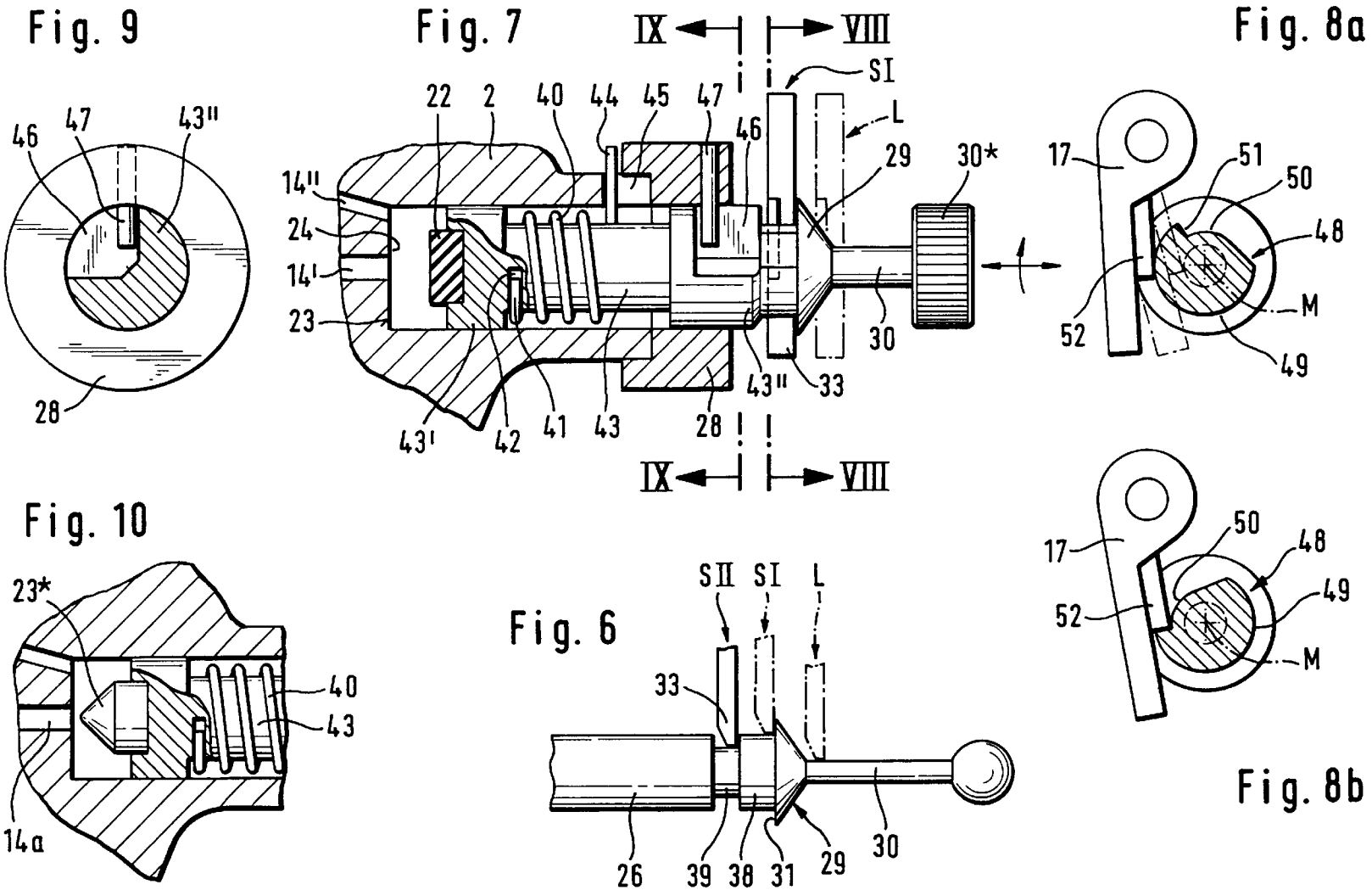
FIG. 6 is a configuration of the shaft for adjusting different start positions.
FIG. 7 is a valve having an axially displaceable and rotatable shaft.
FIGS. 8*a* and 8*b* show detail views of respective lever positions as viewed in the direction of arrows VIII in FIG. 7.
FIG. 9 is a view taken in the direction of arrows IX of FIG. 7.
FIG. 10 is another embodiment of the valve closing element.

FIG. 6 shows a valve shaft 26 having an external surface at the end thereof adjacent the radial collar 29. This external surface is provided with two steps (38, 39) which follow one another in the axial direction. Depending upon the axial displacement of the valve shaft 26 or of the bolt 30, three different positions of the free end 33 of the lever 17 result. The bolt 30 with its end lying close to the radial collar 29 is in the region of the lever 17 during idle L. If the position of the valve shaft 26 changes because of the displacement in the direction of double arrow 36 and the valve 25 is opened as shown in FIGS. 2 and 4, then the end 33 of the lever 17 goes beyond the radial collar 29 and latches into a first start position SI rearward of the radial wall 31. In this way, the free end 33 lies on the peripheral surface of the first step 38. This first start position SI determines the air component of the air/fuel mixture needed for an engine start. The fuel quantity is determined via the fixed throttle 15 shown in FIG. 1.

An air quantity, which is determined by the start position SI, is suitable at normal ambient temperature for the start. This ambient temperature is down to the frost limit and, if required, even somewhat therebelow. For very low ambient temperatures, such as in the range between -10° C. and -30° C., the engine needs a richer mixture for the start. This richer mixture can be obtained by reducing the air component. For this purpose, the second start position SII is provided which the throttle flap assumes when the free end 33 of the lever 17 comes into contact with the second step 39. The throttle flap assumes an angular position in the position SII which is closer to the idle position than the start position SI. The reason for this is that the diameter of the second step 39 is less than the diameter of the first step 38. With the first acceleration of the engine as a consequence of the actuation of the throttle lever, the lever 17 is pivoted (arrow 35) so that its end 33 is disengaged from the valve shaft 26, that is, the radial collar 29. The pressure spring 27 guides the valve shaft 26 into its start position shown in FIG. 2.

For the arrangement shown in FIG. 7, a movement of the valve shaft 43 in the axial direction as well as in the rotational direction is provided. This is achieved in that the forward end of the bolt 30 is provided with a knob 30* which can be actuated in correspondence to the arrows shown. To return into the initial position, a pressure spring 40 is provided which is configured as a helical spring. This pressure spring 40 is held with one end 41 in an opening 45 of the valve shaft 43 and another end 44 of the pressure spring is held in a cutout 46 of the housing 2. With this type of mounting of the helical spring 40, the valve shaft 43 is resiliently biased in the axial direction as well as in the rotational direction by a spring force. The valve shaft 43 includes a cylindrical section 43' which carries on one end the valve closure element 22 and a section 43" at the other end. The section 43" is guided in a bore of the cap 28. This section 43" includes a circle-segment shaped cutout 46 as shown in FIG. 9. A stop pin 47 engages in the cutout 46 and is held in the cap 28 and extends radially.

The region of the section 43" following directly after the radial collar 29 is configured as a coulisse 48 defining a curved path as can be seen in FIGS. 8*a* and 8*b*. The end 33 of the lever 17 can be adjusted to a different spacing to the center axis M of the valve shaft 43 by rotating the valve shaft 43. In this way, a pivot movement of the lever 17 results which, in turn, is transmitted to the throttle flap. The coulisse 48 includes a section 49 having a larger radius as well as a section 50 having a smaller radius and a radial edge 51 behind which a guide section 52, which is formed on lever 17, can engage.

With the aid of the knob 30*, the defined start positions can be adjusted without difficulty. The knob 30* is first only pulled in order to reach a first position and is additionally rotated for the adjustment into a second position. For the first position of the lever 17 shown in FIG. 8*a*, the guide surface 52 lies against the section 49 of the coulisse 48 so that a specific pivot angle with respect to the idle position L results. This idle position L is shown by the broken lines. The contact engagement of the guide surface 52 on the section 49 of the coulisse 48 therefore corresponds to the first start position SI. For a start operation at extremely low temperatures, a richer mixture and therefore a reduced air component is required which is achieved by the start position SII. This start position is shown in FIG. 8*b* wherein the guide section 52 lies against the section 50 having a smaller diameter.

When the start takes place and the engine has stabilized at the start rpm, the throttle flap 6 is opened for the first time via a pivot movement of the lever 17 thereby accelerating the engine. The start system is enabled by the pivot movement of the lever 17 and the valve shaft 43 is moved in the direction toward the end wall 23 by the pressure spring 40. The pressure spring 40 also takes care of resetting the rotational movement if the engine was started in the start position SII. The valve closing element 22 lies against the valve seat 24 so that the ancillary channel 14 is blocked.

FIG. 10 shows another embodiment of the valve 25. The valve closing element 22* shown in FIG. 10 is configured so as to have a conical shape so that its tip can dip into the section 14*a* of the ancillary channel. In this way, the reliability of the seal is increased.

Figure 11:
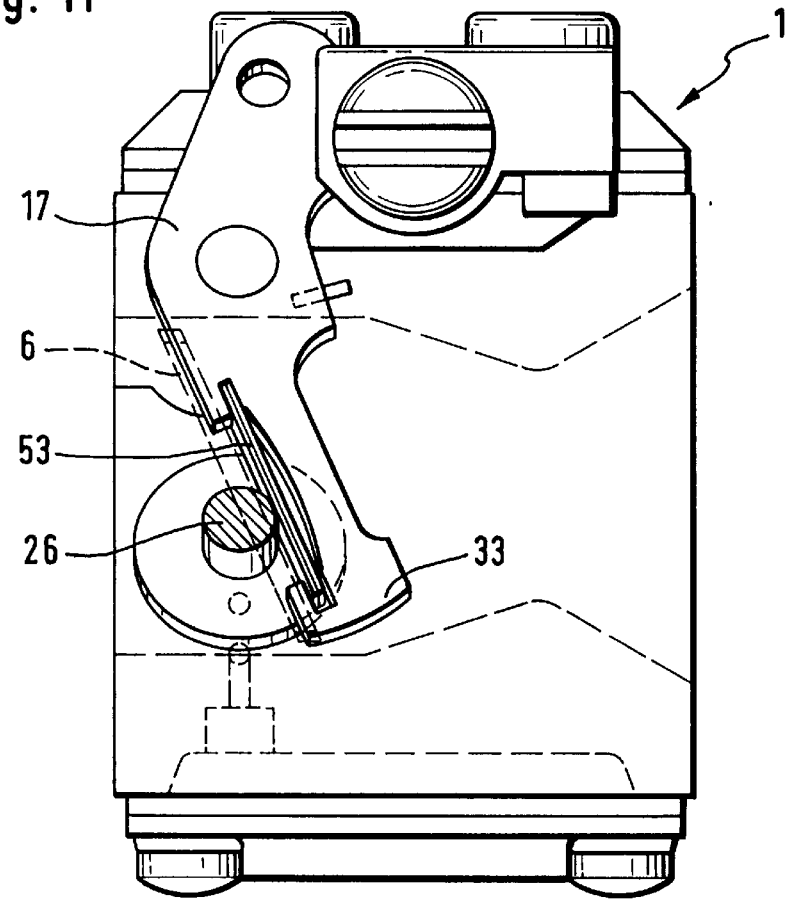
FIG. 11 is another embodiment wherein a temperature-dependent adjustment of the throttle flap is provided; and, FIG. 11*a* is an arrangement of a bimetal on the lever for the throttle flap.
Figure 11A:
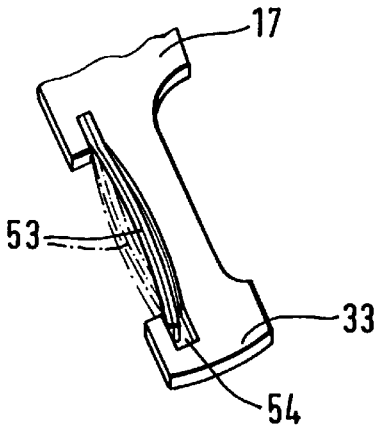

The view in FIG. 11 is similar to the view of the carburetor 1 in FIG. 5. In FIG. 11, the lever 17 does not lie directly with a side edge of the free end against the valve shaft 26; instead, the lever 17 is braced on the valve shaft 26 via a bimetal 53 arranged on the lever 17. As shown in FIG. 11*a*, the bimetal 53 is clamped tight at one end and the other end of the bimetal 53 is movably held in a slot 54. In this way, a temperature dependent adjustment of the throttle flap for the start position is provided; that is, depending upon the ambient temperature, the start air throughput is affected. For a fixedly calibrated fuel quantity for the start operation, it is possible to correspondingly adapt the start air throughput in order to achieve a correspondingly suited start λ in dependence upon the temperature of the air. The arcuate shape of the bimetal in the other direction is shown by the broken lines in FIG. 11*a*.

It is understood that the foregoing description is that of the preferred embodiments of the invention and that various changes and modifications may be made thereto without departing from the spirit and scope of the invention as defined in the appended claims.

What is claimed is:

1. A carburetor for an internal combustion engine of a portable handheld work apparatus, the carburetor comprising:

a carburetor housing having an air-intake channel therein through which air flows to the engine;

said air-intake channel defining a venturi section;

a throttle flap assembly including a throttle flap pivotally mounted in said air-intake channel so as to be movable to positions including an idle position and a start position for allowing respectively different quantities of air to flow to the engine;

a control chamber for holding fuel;

a main fuel channel connecting said control chamber to said air-intake channel;

an idle fuel channel also connecting said control chamber to said air-intake channel;

an ancillary channel connecting said control chamber to said air-intake channel;

a valve unit arranged in said ancillary channel;

said valve unit including a valve closing element movable between a first position wherein said ancillary channel is blocked and a second position wherein said ancillary channel is clear so that fuel can flow therethrough and into said air-intake channel; and, coupling means for coupling said valve closing element to said throttle flap so as to displace said throttle flap out of said idle position to assume said start position when said valve closing element is moved to said second position thereby changing the quantity of air flowing through said air-intake channel.

2. The carburetor of claim 1, wherein said carburetor is a membrane carburetor.

3. The carburetor of claim 1, said valve unit including: a bore communicating with said ancillary channel and having an end wall defining a valve seat; a valve shaft disposed in said bore and having an end face facing toward said valve seat; said valve shaft being longitudinally displaceable in said bore so as to move said valve closing element to block and clear said ancillary channel; and, said valve shaft having an end portion projecting from said carburetor housing.

4. The carburetor of claim 3, said start position being a first start position and said throttle flap being movable to a second start position; said valve shaft being axially movable in said bore between said first position wherein said valve unit is closed and said second position wherein said valve unit is open as well as a third position wherein said valve unit also is open; said second position corresponding to said first start position of said throttle flap and said third position corresponding to said second start position of said throttle flap.

5. The carburetor of claim 4, wherein said throttle flap is pivoted through an angle of from 10° to 15° measured from said idle position to assume said first start position.

6. The carburetor of claim 5, wherein said throttle flap is pivoted through an angle of less than 10° measured from said idle position to assume said second start position.

7. The carburetor of claim 3, said start position being a first start position and said throttle flap being movable to a second start position; said valve shaft being displaceable with a longitudinal movement into said second position corresponding to said first start position (SI) of said throttle flap and, thereafter, being rotationally displaceable into a third position corresponding to said second start position (SII) of said throttle flap.

8. The carburetor of claim 7, wherein said throttle flap is pivoted through an angle of from 10° to 15° measured from said idle position to assume said first start position.

9. The carburetor of claim 8, wherein said throttle flap is pivoted through an angle of less than 10° measured from said idle position to assume said second start position.

10. The carburetor of claim 3, said throttle flap assembly including a pivot pin mounted in said housing and said throttle flap being mounted on said pivot pin; said pivot pin having a segment thereof projecting from said carburetor housing; said coupling means including a lever fixedly attached to said segment; and, said lever having a free end; and, said coupling means further including a peripherally extending surface formed on said end section of said valve shaft; and, said peripherally extending surface and said free end being configured so as to couple said valve shaft to said lever so as to cause said throttle flap to assume said positions thereof when said valve shaft is moved in said bore.

11. The carburetor of claim 10, said lever having an edge at said free end thereof which can be braced against said peripherally extending surface.

12. The carburetor of claim 10, said coupling means further including a bimetal mounted on said free end and being in contact engagement with said peripherally extending surface of said valve shaft.

13. The carburetor of claim 11, said peripherally extending surface having two steps formed thereon and disposed one behind the other viewed in the axial direction of said valve shaft.

14. The carburetor of claim 11, said peripherally extending surface being configured as part of a radial coulisse.

15. The carburetor of claim 3, said throttle flap assembly including a pivot pin mounted in said housing and said throttle flap being mounted on said pivot pin; said pivot pin having a segment thereof projecting from said carburetor housing; said coupling means including a lever fixedly attached to said segment; and, said lever having a free end; and, said coupling means further including a radial collar formed on said end portion of said valve shaft; said carburetor further comprising a bolt extending from said radial collar and said bolt having a cross section significantly smaller than the cross section of said valve shaft; and, said free end and said radial collar being configured so as to couple said valve shaft to said lever so as to cause said throttle flap to assume said positions thereof when said valve shaft is moved in said bore.

16. The carburetor of claim 15, said valve shaft defining a longitudinal axis and said radial collar defining an annular wall perpendicular to said longitudinal axis and said annular wall facing toward said valve shaft; and, said radial collar defining a conical truncated wall surface facing toward said bolt.

17. The carburetor of claim 3, said coupling means including a spring for resiliently biasing said valve shaft toward said valve seat.

18. The carburetor of claim 17, said spring being a helical spring having a first end held in said valve shaft and a second end held in said carburetor housing.

19. The carburetor of claim 7, said coupling means including an annular segment shaped cutout formed in said valve shaft; and, a stop pin held in said carburetor housing and engaging said valve shaft in said cutout.

20. The carburetor of claim 10, said pivot pin defining a longitudinal axis and said valve shaft defining a longitudinal axis; and, said axes conjointly defining an angle of less than 15°.

21. The carburetor of claim 20, said axes conjointly defining an angle of less than 10°.

22. The carburetor of claim 10, said pivot pin defining a longitudinal axis and said valve shaft defining a longitudinal axis; and, said axes being at least approximately parallel to each other.

23. The carburetor of claim 16, said free end of said lever having a side facing toward said truncated wall surface of said radial collar; and, said side of said free end having a bevel formed thereon.

* * * * *